US007963032B2

(12) United States Patent
Signer

(10) Patent No.: US 7,963,032 B2
(45) Date of Patent: Jun. 21, 2011

(54) METHOD FOR DETERMINING THE POSITION OF A WIRE FITTING ON A WIRE

(75) Inventor: Daniel Signer, Emmenbrücke (CH)

(73) Assignee: Komax Holding AG, Dierikon (CH)

( * ) Notice: Subject to any disclaimer, the term of this patent is extended or adjusted under 35 U.S.C. 154(b) by 924 days.

(21) Appl. No.: 11/869,421

(22) Filed: Oct. 9, 2007

(65) Prior Publication Data

US 2008/0083110 A1 Apr. 10, 2008

(30) Foreign Application Priority Data

Oct. 9, 2006 (EP) ..... 06121963

(51) Int. Cl.
*H01R 43/00* (2006.01)

(52) U.S. Cl. ..... 29/857; 29/593; 29/720; 29/754

(58) Field of Classification Search ..... 324/538; 348/86, 125; 439/310; 29/33 M, 450, 593, 29/705, 720, 747, 754, 792, 857, 861
See application file for complete search history.

(56) References Cited

U.S. PATENT DOCUMENTS 4,653,182 A * 3/1987 Fukuda et al. ..... 29/857
5,432,996 A * 7/1995 Imgrut et al. ..... 29/754
5,629,627 A * 5/1997 Hoshino et al. ..... 324/538
5,691,763 A * 11/1997 Ichikawa et al. ..... 348/86
5,724,723 A 3/1998 Saliba et al.
2001/0039707 A1 11/2001 Masuda et al.

FOREIGN PATENT DOCUMENTS

EP 0 626 738 A1 11/1994
EP 0 626 738 B1 11/1994
EP 1 689 049 A1 8/2006
EP 1 016 496 A1 7/2007

* cited by examiner

*Primary Examiner* — Donghai D. Nguyen
(74) *Attorney, Agent, or Firm* — Fraser Clemens Martin & Miller LLC; William J. Clemens

(57) ABSTRACT

A fitting head has a sleeve receptacle and a widener, the fitting head being displaceable forward/backward in the direction of the longitudinal axis of a wire. Also arranged on the fitting head are a transmitter and a receiver. The transmitter generates a curtain-like beam that is positioned between the sleeve receptacle and the widener and can be measured by the receiver. Like the sleeve receptacle and the widener, transmitter and receiver are displaceable forward/backward in the longitudinal axis of the wire, during the forward movement the wire fitting or sleeve being fitted onto the wire and during the backward movement the sleeve being positionally measured. The movement of the fitting head is measured by a stationary measuring head and a scale that moves together with the fitting head. During evaluation of the measurement results, fitting faults are detected.

16 Claims, 6 Drawing Sheets

METHOD FOR DETERMINING THE POSITION OF A WIRE FITTING ON A WIRE

FIELD OF THE INVENTION

The present invention relates to a device and a method for fitting electric wires with wire fittings wherein a fitting module has a fitting head that is movable from a starting position into an end position and back, that fits the stationary wire with the wire fittings.

BACKGROUND OF THE INVENTION

From patent application EP 0 626 738 B1 a device for fitting sleeves onto electric wires has become known. With such devices, sleeves that are required, for example, for moisture-proof pass-throughs of electric wires through housing walls of electrical apparatuses can be efficiently pushed onto the wires. The device comprises a drum with an open end-face that can be filled with sleeves and which can be driven about an axis that is inclined to the horizontal. While the drum is rotating, paddles that are arranged inside the drum pass sleeves to a transporting rail that projects into the drum for the purpose of their positionally correct storage and further transportation. An ejecting device with a centering pin that can be moved up and down guides the respective first sleeve in the transporting rail to a rotating device that has several pins and can be further rotated through a certain angle, such that in a first position of the rotating device one respective sleeve is pushed onto the tip of a pin. In a second position of the rotating device, for the purpose of widening, the sleeve is pushed by means of a pushing-on device onto a part of the pin for the purpose of widening. In a further position of the rotating device, by means of a fitting head with sleeve receptacle and widener, the sleeve is pulled off the pin and the sleeve in widened state is pushed onto the wire.

SUMMARY OF THE INVENTION

The present invention solves the problem of creating a device and method for automatically determining the position of a wire fitting on a wire.

The advantages achieved by means of the present invention are mainly to be seen in that a quality inspection can be performed without the productivity of the fitting module and of the subsequent processing processes being reduced. During the fitting operation, by means of a forward movement of the fitting head, the wire fitting is brought onto the wire and during the backward movement of the fitting head the form and position of the wire fitting on the wire are measured. From the measurement results it can be determined whether the wire fitting is correctly positioned on the wire, or whether in relation to the wire sheath and in relation to the exposed wire conductor it is fitted outside a tolerable deviation. In addition, from the measurement results it can also be determined whether the axial position of the wire fitting deviates from the longitudinal axis of the wire, whether the correct sleeve or any sleeve at all has been fitted, whether the sleeve is turned about 180°, whether the pin that fits the sleeve is correctly set or damaged, or whether during the fitting operation strands of the wire conductor have been fanned out. Further advantageous is that while the position is being measured, the wire end remains stationary, which substantially improves the measurement accuracy. Moreover, during the backward movement of the fitting head, with regard to acceleration/deceleration no account need be taken of the mass of the free wire end with the wire fitting. Wires with different dimensions can be fitted with different sorts of wire fitting without any effect on the measurement accuracy. Also irrelevant for measurement of the position is the usual length of the free wire end of approximately 40 mm. The end of the wire conductor is also measured and the further travel of the fitted wire for the subsequent processing processes thereby released. It is not necessary to wait with further travel of the wire until the fitting head is in the starting position again.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
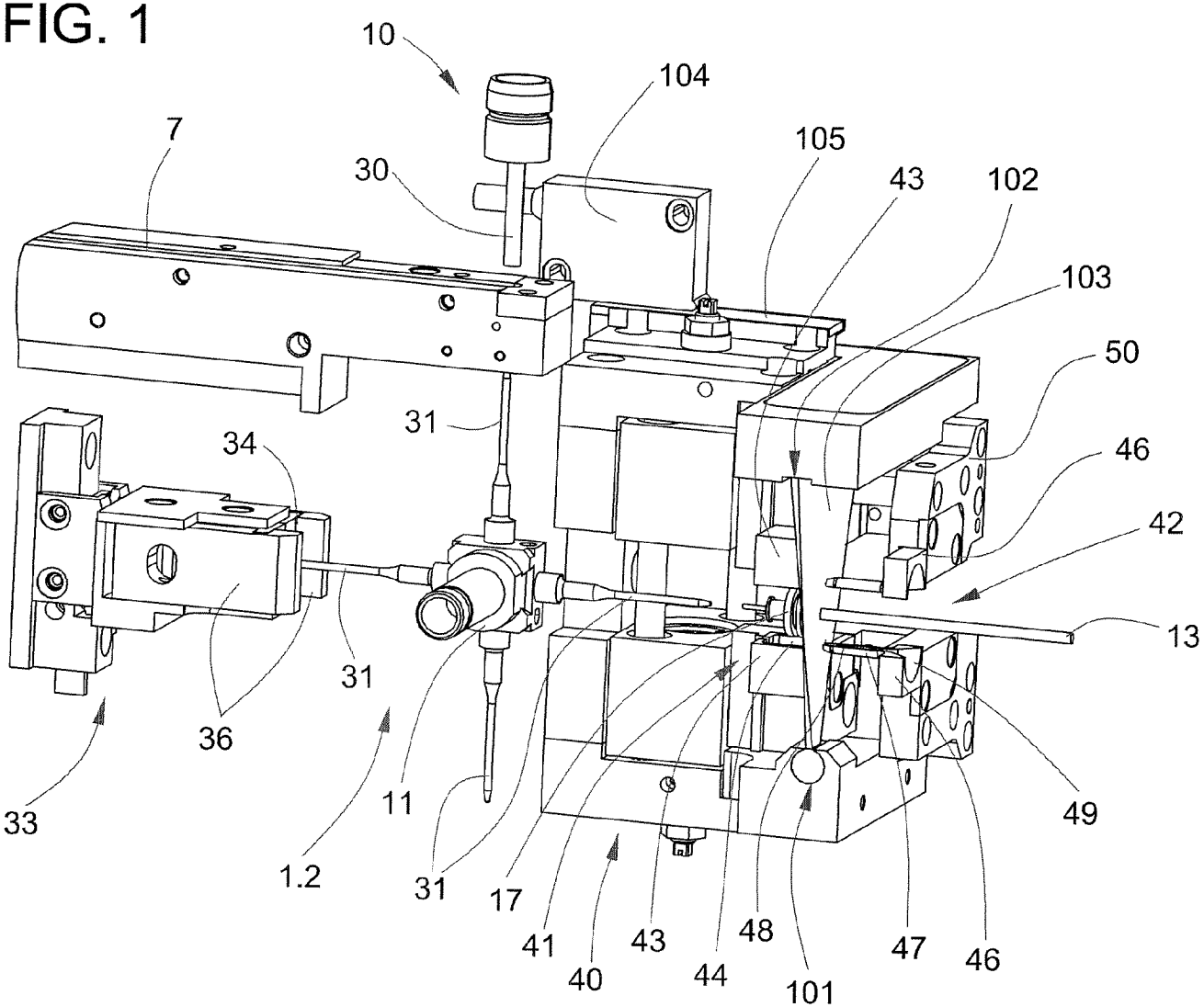
FIG. 1 is a schematic perspective view of a fitting module according to the present invention.

FIG. 1 shows details of a fitting module 1.2 of a device for fitting sleeves as shown in patent application EP 1 689 049 A1. An ejecting device 10 is arranged above a transporting rail 7 for wire fittings, for example sleeves 17. The ejecting device 10 has a centering pin 30 that can be moved up and down, that can be driven for example pneumatically. A rotating device 11, that is arranged under the transporting rail 7, has four pins 31 that are offset to each other at an angle of 90°. The rotating device 11 can be rotated further by an angle of 90° by means of a not-shown stepping motor. The pins 31 have two different diameters, the diameter in the area of the point of the pin being the smaller. The rotating device 11 is arranged in such manner that always a pin 31 aligns in a first position "I" of the rotating device 11 with the vertical round hole 24 (FIG. 4*a*-4*g*) of the transporting rail 7. Designated with 33 is a push-on unit that has two forming plates 34 in each of which one half of a round hole 35 (FIG. 4*a*-4*g*) is arranged that in a second position "II" of the rotating device 11 always aligns with one of the pins 31. The forming plates 34 are fastened to holders 36. The push-on device 33 can be pushed (for example pneumatically) in a straight line in the direction of the pin 31.

A fitting head 40 has a sleeve receptacle 41 and a widener 42, the fitting head 40 being displaced forward/backward in the direction of the longitudinal axis of the wire. The sleeve receptacle 41 consists of two jaws 43 that each have half of a cylindrical opening 44 whose size is adapted to the form of the sleeves 17 that are to be processed. The jaws 43 are arranged on a not-visible guide support in such manner as to be movable (for example pneumatically) in radially opposite directions. The widener 42 consists of two further jaws 46 that each have one half of a sleeve-shaped projection 47 and a round hole 48 that passes through the latter. On the side of the further jaw that faces away from the sleeve-shaped projection 47, the round hole 48 has a funnel-shaped expansion 49 and is of such dimensions that an electric wire 13 that is to be fitted can be accommodated. The further jaws 46 are arranged displaceably on a further guide support 50, being movable forward/backward simultaneously with the jaws 43. The sleeve receptacle 41 and the widener 42 are arranged in such manner that in a further position "IV" of the rotating device 11 the cylindrical opening 44 and the round hole 48 align with one of the pins 31, whereby the further position "IV" is offset relative to the second position "II" by an angle of 180°. The sleeve acceptance part 41 is arranged displaceably (for example pneumatically) within a U-shaped opening of the further guide support 50 in the axial direction of the cylindrical opening 44. The further guide support 50 is joined to a housing that together with the sleeve acceptance part 41 and the widener 42 can be moved (also for example pneumatically) forward/backward in the axial direction of the cylindrical opening 44 and the round hole 48.

Also arranged on the fitting head 40 are a transmitter 101 with lens, for example an LED light transmitter, and a receiver 102, for example a CCD line sensor. The transmitter 101 generates a curtain-like beam 103 that is positioned between the sleeve receptacle 41 and the widener 42 and can be measured by the receiver 102. The transmitter 101 and the receiver 102 are mounted on the two-part sleeve receptacle 41 and can be moved forward/backward in the direction of the longitudinal axis of the wire, with the wire fitting or sleeve 17 being fitted onto the wire 13 during the forward movement and the wire fitting or sleeve 17 being measured for form and position during the backward movement.

Arranged on the fitting module 1.2 is a measuring head 104 for measuring the travel of the fitting head 40, in particular for measuring the travel of the fitting head 40 when moving backward. Relative to the fitting head 40, the measuring head 104 is arranged positionally fixed on the fitting module 1.2 and by means of a scale 105 that is arranged on the fitting head 40 and measures the relative movement of the fitting head 40 relative to the fitting module 1.2 on the longitudinal axis of the wire.

Figure 2:
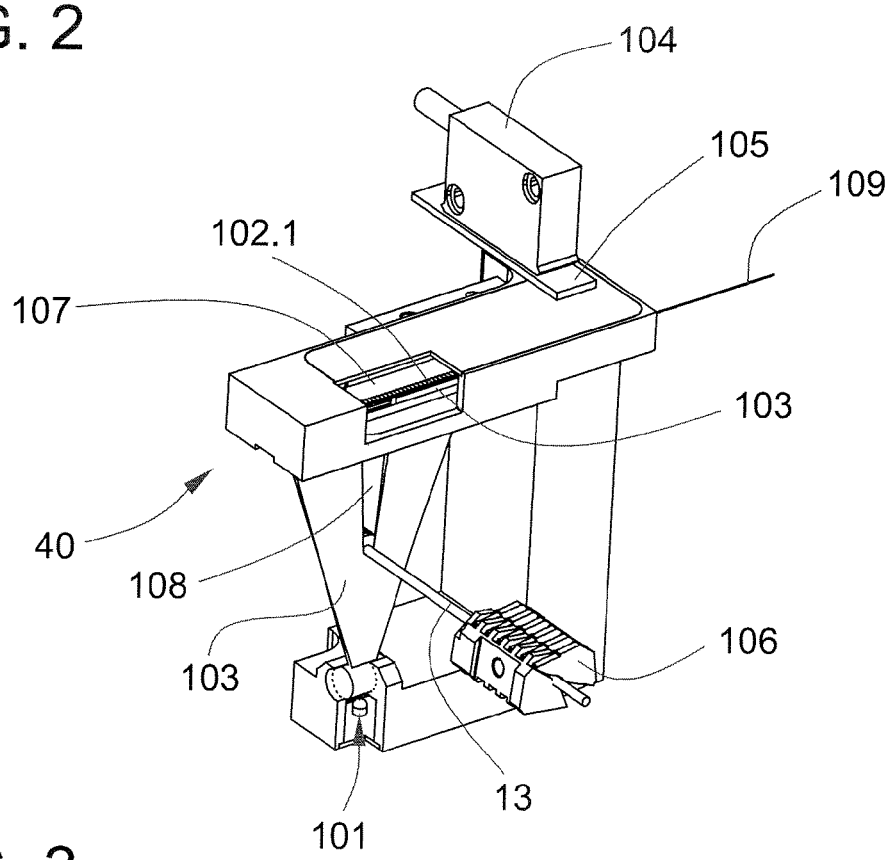
FIGS. 2 and 3 are enlarged schematic perspective views of a measurement device that is arranged on the fitting module shown in FIG. 1.
Figure 3:
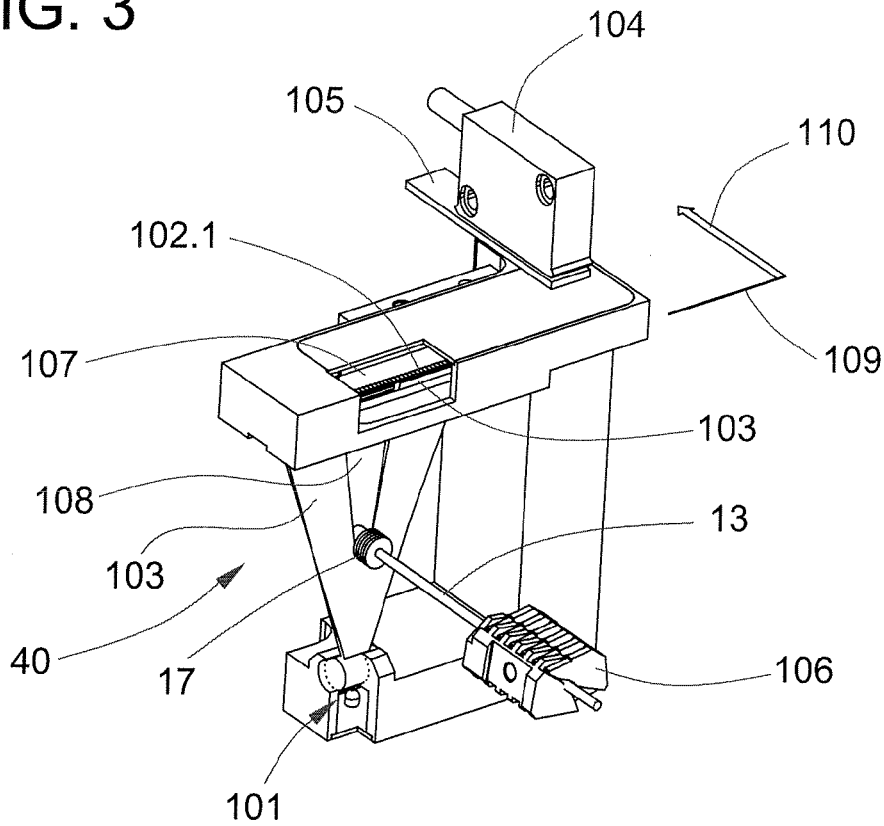

FIGS. 2 and 3 show the measuring device that is arranged on the fitting module 1.2 or the fitting head 40 consisting of the transmitter 101 with the beam 103, the receiver 102, and the measuring head 104 with the scale 105. The position of the beam 103 as shown in FIG. 2 corresponds approximately to the position of the beam as shown in FIG. 4*e*. The wire 13 is held by a gripper 106 that during the fitting operation and during the measurement operation is not moved. During the fitting operation, the fitting head 40 has been moved forward into the end position 109, whereupon the beam 103 projects the outline of the wire sheath in the position of the beam 103 at the receiver 102. Visible in the cutaway 107 of the fitting head 40 is a line sensor, for example a CCD line sensor 102.1, that detects the curtain-like beam 103, for example of an LED light transmitter. The elements of the CCD line sensor 102.1 register the beam 103 as well as the beam shadow 108 that is caused by the wire outline. The beam shadow 108 corresponds to the wire outline.

As shown in FIG. 3, the fitting head 40 has been moved or displaced in the direction of the starting position, which is symbolized with an arrow 110. The position of the beam 103 as shown in FIG. 3 corresponds approximately to the position of the beam 103 as shown in FIG. 4*f*. The displacement of the fitting head 40 can also be read on the scale 105 that relative to the fixed measuring head 104 has moved equally far in the direction of the starting position as the fitting head 40. The elements of the CCD line sensor 102.1 register the beam 103 as well as the beam shadow 108 that is caused by the sleeve outline. The beam shadow 108 corresponds to the sleeve outline.

Figure 4A:
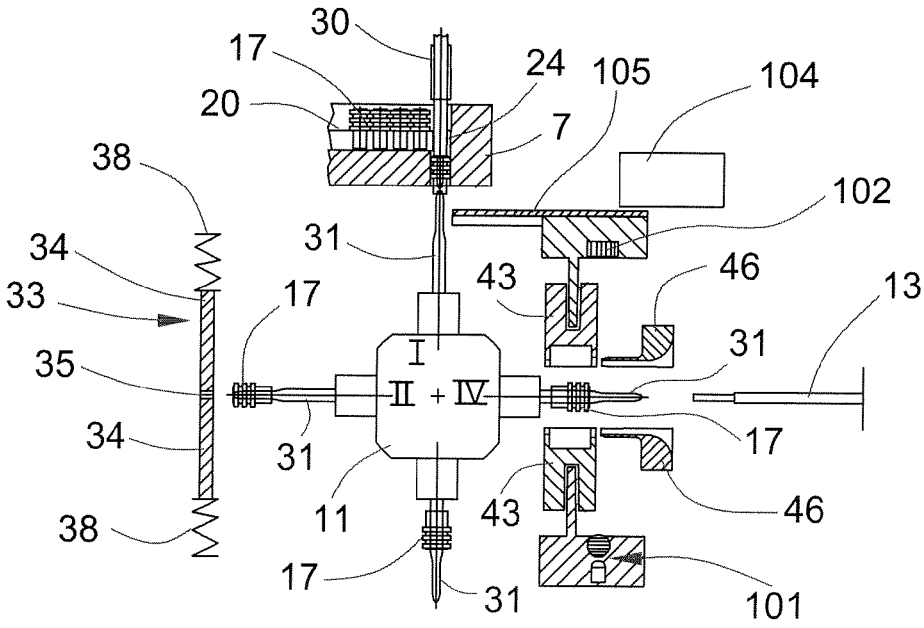
FIGS. 4*a* to 4*g* are schematic cross-sectional views of the fitting module in operation to fit wires with wire fittings.
Figure 4B:
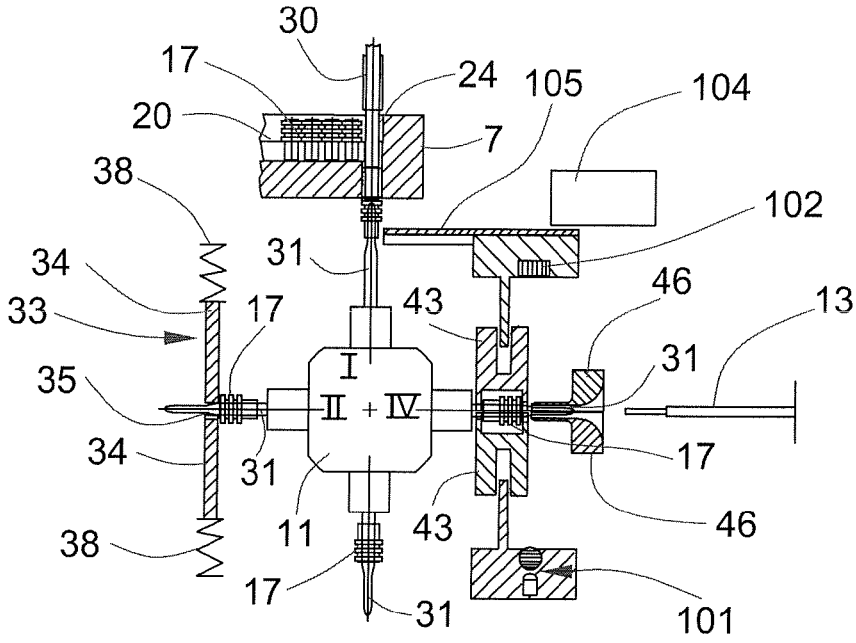
Figure 4C:
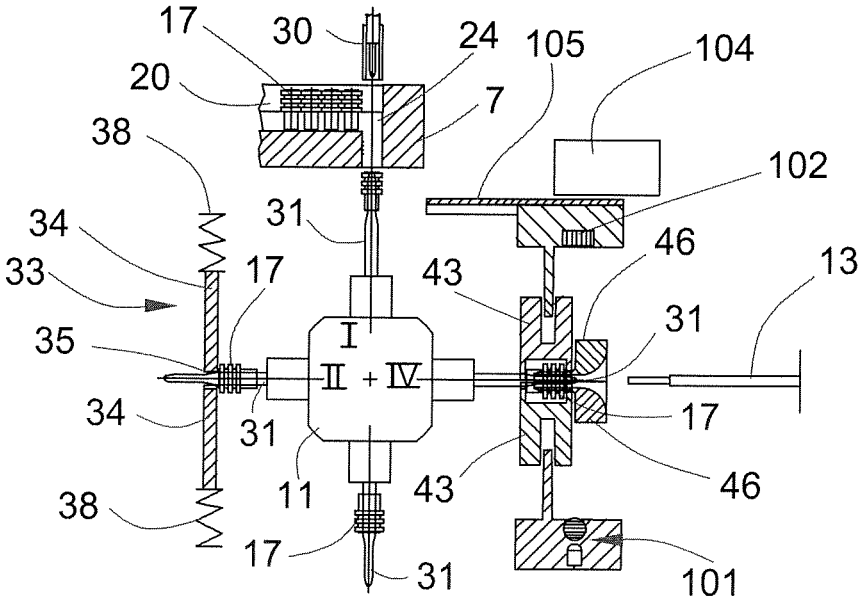
Figure 4D:
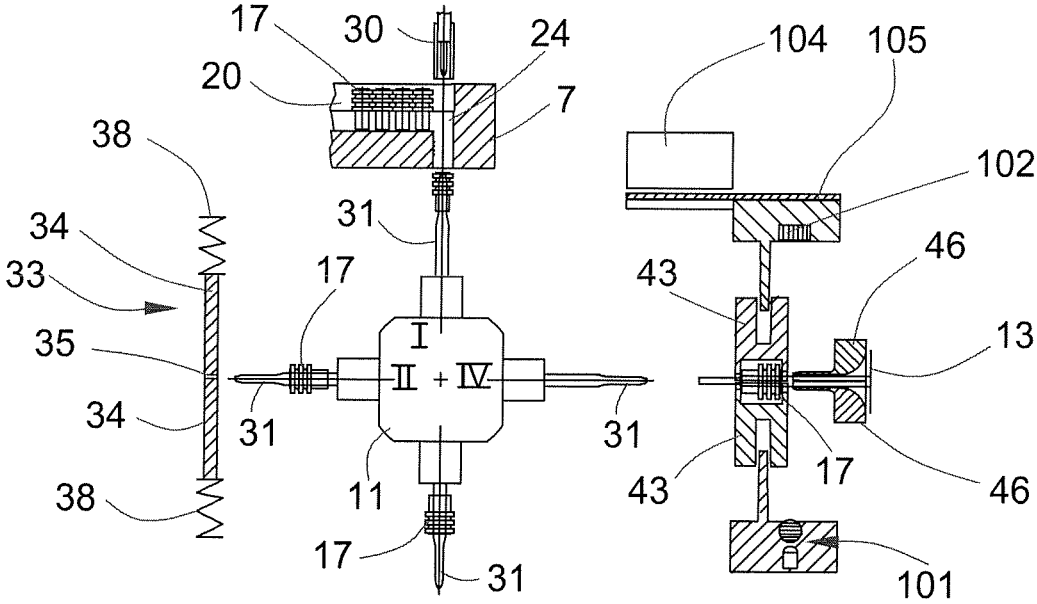
Figure 4E:
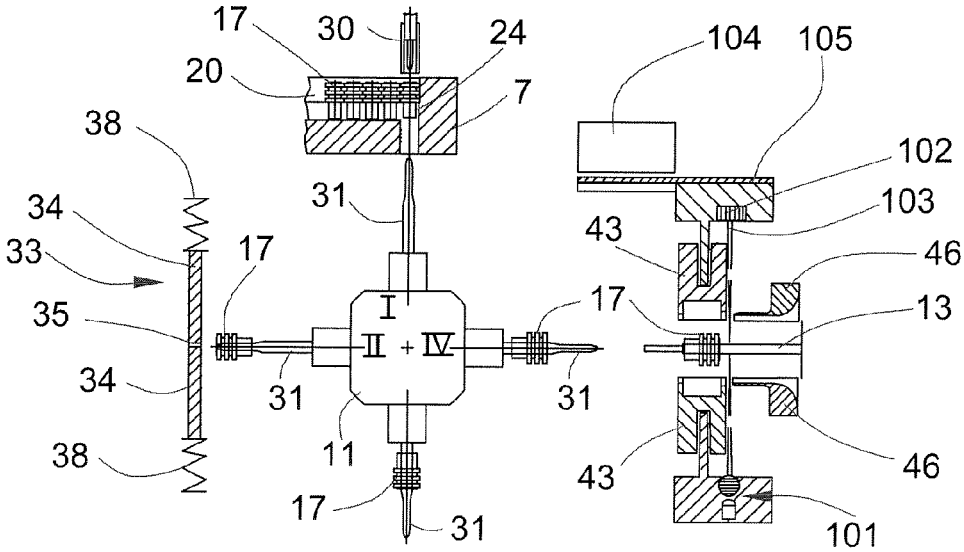
Figure 4F:
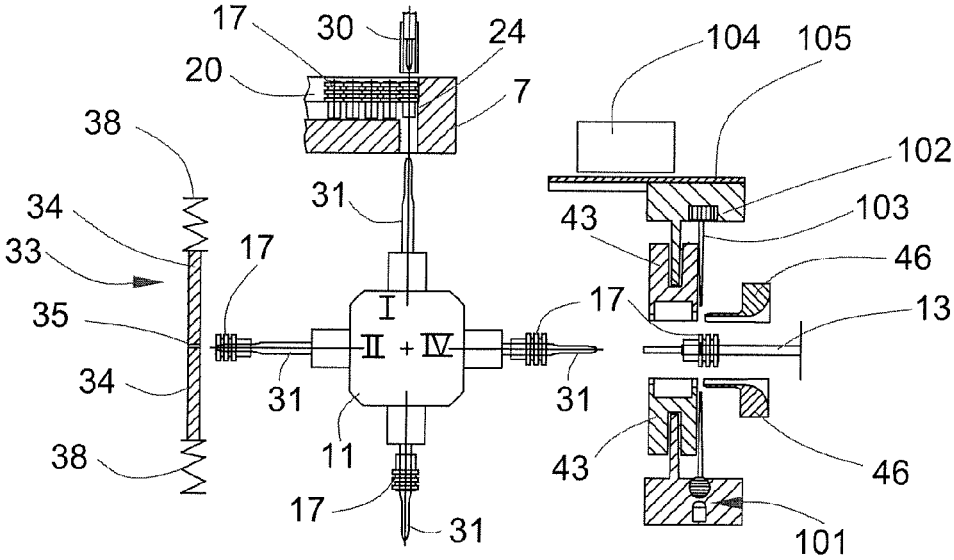

The wire 13 is fitted with The wire fitting and the sleeve 17 and measured (FIGS. 4*a* to 4*g*) as follows:

After the sleeves 17 have been positionally correctly buffered on the transporting rail 7, the respective front most sleeve 17 in the buffer 20 is transported over the vertical round hole 24 (FIG. 4*a*). By means of the centering pin 30 of the ejecting device 10, the sleeve 17 is now pushed onto the tip of the pin 31 that is positioned in the first position "I" (FIGS. 4*a*, 4*b*). Simultaneously, a sleeve 17 sitting on a pin 31 that is in the second position "II" is pushed by means of the pushing-on unit 33 onto the thicker part of the pin 31 whereby it is widened and brought into the correct position. Since the round hole 35 is smaller than the pin 31, the form plates 34 are thereby pushed apart against a spring force (FIG. 4*b*). During the same time, a sleeve 17 that is sitting on the pin 31 that is in the further position "IV" is embraced by the jaws 43, whereby the further jaws 46 of the sleeve receptacle 42 are closed (FIGS. 4*a*, 4*b*). The centering pin 30 of the ejecting device 10 is then pulled back and the sleeve receptacle 41 is pushed with the sleeve 17 against the widener 42, whereby the bush-like projection 47 of the widener 42 penetrates into the sleeve bore and the sleeve 17 is again slightly widened (FIG. 4*c*). The push-on unit 33 is then pushed back and by means of the sleeve receptacle 41 the sleeve 17 pulled off the pin 31 and transported in the direction of the wire 13. The sleeve 17 is hereby held by the widener 42 in the widened state until the correct position on the wire 13 is reached. The widener 42 is then displaced relative to the sleeve receptacle 41, whereby the sleeve 17 is slid off and jams itself onto the wire 13 (FIG. 4*d*). The jaws 43 and 46 then open so that the fitted wire 13 can be removed and a new one fed. At the same time, the rotating device 11 rotates through an angle of 90°, whereby the empty pin 31 is turned into the first position "I" and the already fitted pins 31 are turned into the second position "II" and into the further position "IV" respectively (FIG. 4*e*).

Figure 4G:
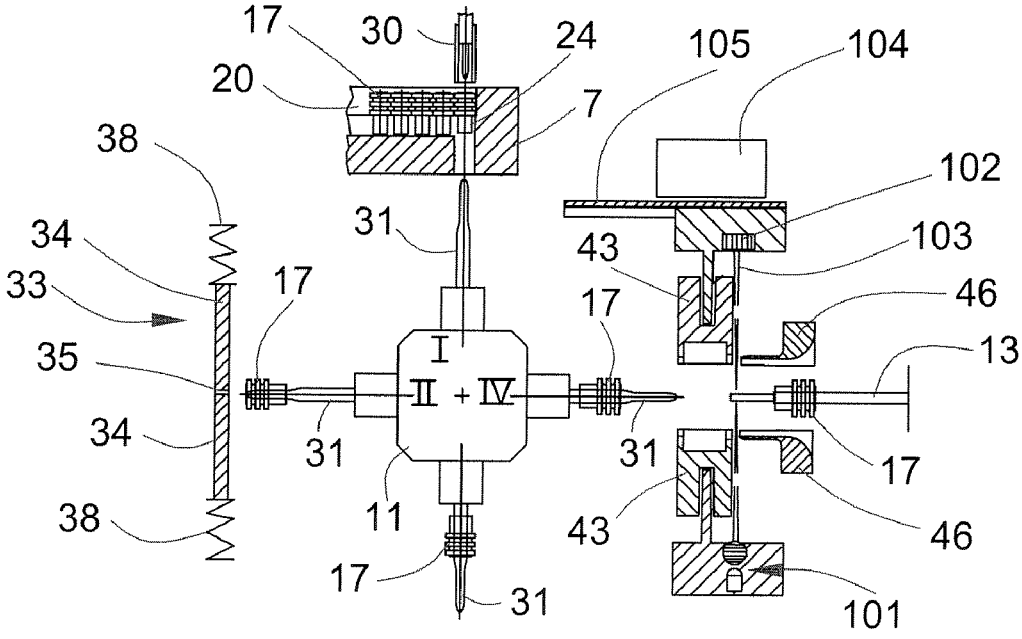

In the process steps of FIGS. 4*a* to 4*e*, the fitting head 40, the sleeve receptacle 41, and the widener 42 have moved in a forward direction from the starting position according to FIG. 4*a* into the end position according to FIG. 4*e* and with them also the transmitter 101, the receiver 102, and the scale 105. During the fitting operation and during the measurement operation, the wire 13 remains positionally fixed and is not moved. As shown in FIG. 4*e*, on completion of the fitting operation the transmitter 101 is first switched on and the beam 103 measured by the receiver 102. At the same time, the positionally fixed measuring head 104 measures by means of the scale 105 the position of the fitting head 40 and the position of the beam 103. In FIG. 4*e* the outline of the wire sheath is represented by the position of the beam 103 at the receiver 102. The fitting head 40 is then moved or displaced backward from the end position according to FIG. 4*e* towards, and as far as, the starting position according to FIG. 4*a*. As shown in FIG. 4*f*, the beam 103 is positioned approximately in the middle of the wire fitting and in the middle of the sleeve 17 respectively. The receiver 102 then measures the outline of the wire fitting or sleeve 17 respectively at the position of the beam 103. The fitting head 40 is then moved or displaced backward again until the beam 103 is positioned approximately at the wire conductor that is freed from wire sheath as shown in FIG. 4*g*. The outline of the wire conductor is then represented by the position of the beam 103 at the receiver 102. The sleeve receptacle 41 and the widener 42 are then moved further in backward direction until the starting position shown in FIG. 4*a* is reached.

In reality, not three measurements are performed but several hundred measurements, for example every fifty micrometers, for each measurement the position of the beam 103 relative to the stationary wire 13 being registered by means of the measuring head 104 and the scale 105. At each position measurement, the control of the measuring head 104 initializes the transmitter 101 and the receiver 102. Transmitter 101 and receiver 102 are synchronized on the measurement head 104. From the projections in the receiver 102 together with the position measurements, a silhouette of the wire 13 with the fitted sleeve 17 or wire fitting is generated and compared with a template or characteristics of the sleeve 17. Template and the characteristics of the sleeve are, for example, saved as a table in the control of the fitting module 1.2. Thus, for example, perforated sleeves that are therefore mounted not straight on the wire, sleeves that are too far or not far enough from the end of the wire sheath, wrong sleeves, sleeves that are turned by 180°, damaged or wrong pin, or strands of the wire conductor that are fanned out during the fitting process, can be detected. The control of the fitting module also knows the characteristics of the pins that match the sleeves, the pins being measured by means of a separate measurement run. The end of the wire conductor is also measured and the further travel of the fitted wire for the subsequent processing processes thereby released. It is not necessary to wait with further travel of the wire until the fitting head is in the starting position again.

The fitting head 40 can also be set up for other wire fittings than sleeves 17. For example, the wire conductors that have been freed of wire sheath can be fitted with end-bushes. With a forward movement of the fitting head, the end-bushes are pushed onto the wire conductor and squeezed. During the backward movement from the end position into the starting position, the wire together with the end-sleeve is measured in comparable manner to the sleeve and fitting errors are detected when the measurement results are evaluated.

Other measurement systems than the optical measurement device mentioned above are conceivable, for example measuring devices that are based on ultrasonics or radar.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of measuring electric wires with wire fittings utilizing a fitting module and a fitting head that is movable from a starting position into an end position and back, comprising the steps of:

a. during the movement of the fitting head from the starting position into the end position along a linear path parallel to a longitudinal axis of a wire, fitting the wire with a wire fitting;

b. during the movement of the fitting head from the end position into the starting position, measuring the wire with the wire fitting to generate measurement results; and c. during an evaluation of measurement results detecting fitting faults.

2. The method according to claim 1 wherein a transmitter is arranged on the fitting head and transmits a beam, the wire that is to be measured and the wire fitting extend in the beam and are measured by a receiver of the beam that is arranged on the fitting head.

3. The method according to claim 2 wherein from measurement values generated by the receiver and measurement values generated by the measuring head a silhouette of the wire with the wire fitting is generated and compared with a template or characteristics of the wire fitting and from the comparison fitting faults are detected.

4. The method according to claim 3 wherein the template or the characteristics of the wire fitting are saved in a control of the fitting module.

5. The method according to claim 3 wherein an end of the wire is measured and thereby further travel of the fitted wire for a subsequent processing process is released.

6. The method according to claim 1 including measuring a displacement of the fitting head relative to the fitting module by a scale that is arranged on the fitting head and by a measuring head that is arranged on the fitting module.

7. A method of measuring electric wires with wire fillings utilizing a fitting module and a fitting head that is movable from a starting position into an end position and back, comprising the steps of:

a. during the movement of the fitting head from the starting position into the end position, fitting a wire with a wire fitting;

b. during the movement of the fitting head from the end position into the starting position, measuring the wire with the wire fitting to generate measurement results wherein a transmitter is arranged on the fitting head and transmits a beam, the wire that is to be measured and the wire fitting extend into the beam and are measured by a receiver of the beam that is arranged on the fitting head; and c. during an evaluation of measurement results detecting fitting faults.

8. The method according to claim 7 including measuring a displacement of the fitting head relative to the fitting module by a scale that is arranged on the fitting head and by a measuring head that is arranged on the fitting module.

9. The method according to claim 7 wherein from measurement values generated by the receiver and measurement values generated by the measuring head a silhouette of the wire with the wire fitting is generated and compared with a template or characteristics of the wire fitting and from the comparison fitting faults are detected.

10. The method according to claim 9 wherein the template or the characteristics of the wire fitting are saved in a control of the fitting module.

11. The method according to claim 9 wherein an end of the wire is measured and thereby further travel of the fitted wire for a subsequent processing process is released.

12. A method of measuring electric wires with wire fittings utilizing a fitting module and a fitting head that is movable from a starting position into an end position and back, comprising the steps of:

a. during the movement of the fitting head from the starting position into the end position, fitting a wire is fitted with a wire fitting;

b. during the movement of the fitting head from the end position into the starting position, measuring the wire with the wire fitting is measured to generate measurement results including measuring a displacement of the fitting head relative to the fitting module by a scale that is arranged on the fitting head and by a measuring head that is arranged on the fitting module; and c. during an evaluation of measurement results detecting fitting faults are detected.

13. The method according to claim 12 wherein a transmitter is arranged on the fitting head and transmits a beam, the wire that is to be measured and the wire fitting extend in the beam and are measured by a receiver of the beam that is arranged on the fitting head.

14. The method according to claim 12 wherein from measurement values generated by the receiver and measurement values generated by the measuring head a silhouette of the wire with the wire fitting is generated and compared with a template or characteristics of the wire fitting and from the comparison fitting faults are detected.

15. The method according to claim 14 wherein the template or the characteristics of the wire fitting are saved in a control of the fitting module.

16. The method according to claim 14 wherein an end of the wire is measured and thereby further travel of the fitted wire for a subsequent processing process is released.

* * * * *